US007535327B2

(12) United States Patent
Desilva et al.

(10) Patent No.: US 7,535,327 B2
(45) Date of Patent: May 19, 2009

(54) CIRCUIT BREAKER

(75) Inventors: W. P. Hemantha Desilva, Konosu (JP); Koji Asakawa, Konosu (JP); Hideto Yamagata, Konosu (JP); Akifumi Sato, Konosu (JP); Yasuhiro Takahashi, Konosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 372 days.

(21) Appl. No.: 11/492,062

(22) Filed: Jul. 25, 2006

(65) Prior Publication Data

US 2007/0035367 A1 Feb. 15, 2007

(30) Foreign Application Priority Data

Aug. 12, 2005 (JP) ..... 2005-233947

(51) Int. Cl.
*H01H 13/04* (2006.01)

(52) U.S. Cl. ..... 335/174; 335/202

(58) Field of Classification Search ..... 335/8–16, 335/132, 202, 172–174, 201
See application file for complete search history.

(56) References Cited

U.S. PATENT DOCUMENTS

| | | | | | |
|---|---|---|---|---|---|
| 5,162,766 | A | * | 11/1992 | Morris et al. | 335/202 |
| 5,466,903 | A | * | 11/1995 | Faber et al. | 200/400 |
| 5,488,338 | A | * | 1/1996 | Seymour et al. | 335/202 |
| 5,608,367 | A | * | 3/1997 | Zoller et al. | 335/132 |
| 5,633,483 | A | * | 5/1997 | Oster et al. | 200/17 R |

FOREIGN PATENT DOCUMENTS

| | | |
|---|---|---|
| JP | H06-236726 | 8/1994 |
| JP | H07-141976 | 6/1995 |
| JP | 3246562 | 11/2001 |

* cited by examiner

*Primary Examiner*—Elvin G Enad
*Assistant Examiner*—Bernard Rojas
(74) *Attorney, Agent, or Firm*—Manabu Kanesaka

(57) ABSTRACT

A circuit breaker includes a main case containing a contactor section, an arc-extinguishing device and an overcurrent tripping device; a middle cover laid on the main case, the middle cover having in a central section thereof a recess partitioned with a bottom wall for containing a switching mechanism and at least one interior attachment; and a top cover covering the top side of the recess in the middle cover. The main case, the middle cover and the top cover are arranged to be dividable from one another. The middle cover has an auxiliary cover, covering the switching mechanism, and the auxiliary cover has the top cover mounted thereon.

5 Claims, 4 Drawing Sheets

CIRCUIT BREAKER

BACKGROUND OF THE INVENTION AND RELATED ART STATEMENT

The present invention relates to a circuit breaker such as a molded-case circuit breaker or an earth leakage breaker. Particularly, the invention relates to an assembly structure of a molded case containing functional parts of the breaker.

As known, a molded-case circuit breaker incorporates contactor sections, each including a stationary contactor and a movable contactor of a main circuit, arc-extinguishing devices for the respective contactor sections, a switching mechanism for the movable contactors, and an overcurrent tripping device, which are assembled together in a molded case. Moreover, an earth leakage breaker includes, besides functional parts making up a molded-case circuit breaker, a leakage current detection section (a zero-phase current transformer and a leakage current detection circuit) and an over current protection device additionally installed in a molded case (see Japanese Patent No. 3246562, for example).

In the circuit breaker with the above arrangement, interruption of an overcurrent such as a short-circuit current causes an arc to occur between a stationary contact and a movable contact in the main circuit. The heat of the arc causes contactors made of metal to melt and evaporate. The evaporated molten metals scatter with arc gas and deposits onto movable parts of the switching mechanism and the tripping device, which causes interruption in the function. Thus, as a measure for preventing the problem, the following structure is known (see JP-A-7-141976, for example). In the structure, an intermediate base is incorporated inside a molded case so that a current interruption section and an arc-extinguishing device are isolated from the switching mechanism arranged above them with the intermediate base serving as a partition wall.

In addition, a circuit breaker having other attachments is known. In the structure, for allowing easy mounting of the attachments of the circuit breaker such as an auxiliary switch, an alarm switch, and shunt release, pocket-like recesses are formed beforehand on the cover of a molded case. In the recess, the attachment is retained in cassette form and an auxiliary cover is provided to cover the top sides of the attachments (see JP-A-6-236726, for example).

Aside from the structure disclosed in JP-A-7-141976 in which an intermediate base is incorporated inside a molded case, a circuit breaker with the following assembly structure was already developed and commercialized. In the assembly structure, a molded case is designed to isolate the switching mechanism from the current interruption section that has capability of containing interior attachments like the molded case disclosed in JP-A-6-2367276. The molded case has a structure of three parts, which are a main case (lower cover), a middle cover laid on the top side of the main case with a recess, partitioned by a bottom wall, formed in its central section, and a top cover covering the top side of the recess in the middle cover. The contactor sections, the arc-extinguishing device, and the overcurrent tripping device are contained in the main case. The switching mechanism and interior attachments are contained in the recess in the middle cover. In the following, the assembly structure of the circuit breaker is shown in FIG. 4.

In FIG. 4, reference numeral 1 denotes the molded case (a resin molded product) with the structure dividable into three parts, i.e. the main case (a lower case) 2, the middle cover 3 and the top cover 4. Reference numerals 5, 6, 7 and 8 denote a stationary contactor integrated with a power supply side terminal, a load side terminal, a movable contactor, and a contactor holder rotatably supporting the movable contactor 7, respectively. Reference numeral 9 denotes the arc-extinguishing device. Reference numerals 10, 10*a* and 11 denote the switching mechanism of a toggle link type, a switching operation lever, and a tripping mechanism linked to the toggle link of the switching mechanism 10, respectively.

Reference numeral 12 denotes an overcurrent tripping device that detects an overcurrent in a main circuit to actuate the tripping mechanism 11, and reference numeral 13 denotes a zero-phase current transformer mounted in an earth leakage breaker for detecting a leak current in the main circuit. The zero-phase current transformer 13 has a leak current detection IC connected to the secondary side to form a leak current detection section. The switching operation and the current interruption operation of the circuit breaker are known, so explanations are omitted.

Here, in the main case 2 of the molded case 1, units, each including the stationary contactor 5, the movable contactor 7, and the arc-extinguishing device 9 for each of the phases of the main circuit, are contained parallel in the lateral direction. On the back of the units, the overcurrent tripping device (thermal device) 12 and the zero-phase current transformer 13 on the further back are arranged between the load side terminals 6.

Moreover, the middle cover 3 laid on the main case 2 has a pocket-like recess 3*a* formed at the central section with a wall provided around the recess 3*a* for partitioning. The recess 3*a* is provided so that the switching mechanism 10 and the tripping mechanism 11 are contained in the middle. The previously described overcurrent protection device of the earth leakage breaker and the interior attachments (not shown) such as the auxiliary switch, the alarm switch, and the shunt release are contained on the side of the recess 3*a*. Furthermore, through a slit opened in a bottom wall 3*b* of the recess 3*a*, a lower toggle link 10*b* of the switching mechanism 10 is made to project downward to couple with the contactor holder 8 of the movable contactor 7.

Further, on the top side of the middle cover 3, the top cover 4 is mounted to cover the top side of the recess 3. The top cover 4 has an opening at the center so that the switching operation lever 10*a* of the switching mechanism 10 is made to project outside through that opening.

The circuit breaker described above with background structures has the following problems from the viewpoint of easiness in maintenance and assembly. Namely, devices such as the auxiliary switch, the alarm switch and the shunt release as the attachments of the circuit breaker are often mounted by a user after the circuit breaker is delivered. In this case, mounting and removal of the attachments are carried out by making access to the recess 3*a* in the middle cover 3 with the top cover 4 shown in FIG. 4 being removed. At the access, danger of injury arises such as an accidental touch of a fingertip of a worker on the tripping mechanism 11 in the switching mechanism 10. This causes an unexpected tripping action of the switching mechanism, by which the finger of the worker is pinched.

In addition, in the assembly process of the earth leakage breaker, with the functional parts that make up the molded-case circuit breaker being assembled in the main case 2, the zero-phase current transformer 13 (the leakage current detection section) is mounted. Furthermore, in addition to mounting on the middle cover 3 equipped with the switching mechanism 10 and the overcurrent protection circuit, on the main case 2, lead wires taken out from the leakage current detection section are connected to the overcurrent protection device mounted in the middle cover 3. The wiring carried out with the switching 10 being exposed will cause an unexpected tripping action of the switching mechanism as described above, resulting in a finger pinched in the switching mechanism.

The invention was made in view of the foregoing, and an object of the invention is to provide a circuit breaker with the structure of a molded case based on the structure shown in FIG. 4 with improvement on easiness in assembly and maintenance.

SUMMARY OF THE INVENTION

In order to achieve the above objective, according to the first aspect of the invention, a circuit breaker includes a main case, a middle cover and a top cover built separately from one another. The main case contains a contactor section, an arc-extinguishing device and an overcurrent tripping device. The middle cover laid on the main case, has the central section and a recess partitioned with a bottom wall for containing a switching mechanism and interior attachments. The top cover covers the top side of the recess in the middle cover. The middle cover is made to have an auxiliary cover, which covers the switching mechanism. The middle cover combined with the auxiliary cover is made to have the top cover mounted. The auxiliary cover is specifically designed according to the following second and third aspects of the invention.

(1) The auxiliary cover covers a region excluding the containing section of the interior attachments and has the top cover hinged thereto at the end section thereof (the second aspect).

(2) The auxiliary cover is divided into a section covering the switching mechanism, a section covering a peripheral surface region of the switching mechanism, and a section covering the switching mechanism, which is mounted on the main case (the third aspect).

With the foregoing arrangement of the top cover of the circuit breaker made accessible, the switching mechanism is covered with the auxiliary cover. Therefore, when the interior attachments are mounted on or removed from the circuit breaker, with accessibility to the containing section of the interior attachments (the recess) formed in the middle cover 3 made without causing any possible touch of a finger on the switching mechanism, mounting and removal of the attachments can be carried out. This enhances safety in maintenance work carried out by the user.

Moreover, the arrangement according to the third aspect of the invention is provided so that the auxiliary cover is divided into sections covering the switching mechanism and peripheral surface region of the switching mechanism. Section covering the switching section is independently mounted on the main case. By adopting this arrangement, in the assembly process of the earth leakage breaker, when the leakage current detection section and the overcurrent protection device are additionally mounted on the molded case having the functional parts of the molded-case circuit breaker already mounted, the assembly work can be carried out with the switching mechanism mounted on the middle cover and covered with the cover section, with only the other cover section being removed. This allows mounting work of the leakage current detection section on the main case and wiring work between the leakage current detection section and the overcurrent protection device mounted on the middle cover to be safely carried out without causing any possible touch on the switching mechanism. Therefore, enhanced easiness in assembly and safety in assembly work can be ensured.

DETAILED DESCRIPTION OF THE PREFERRED EMBODIMENTS

Figure 1:
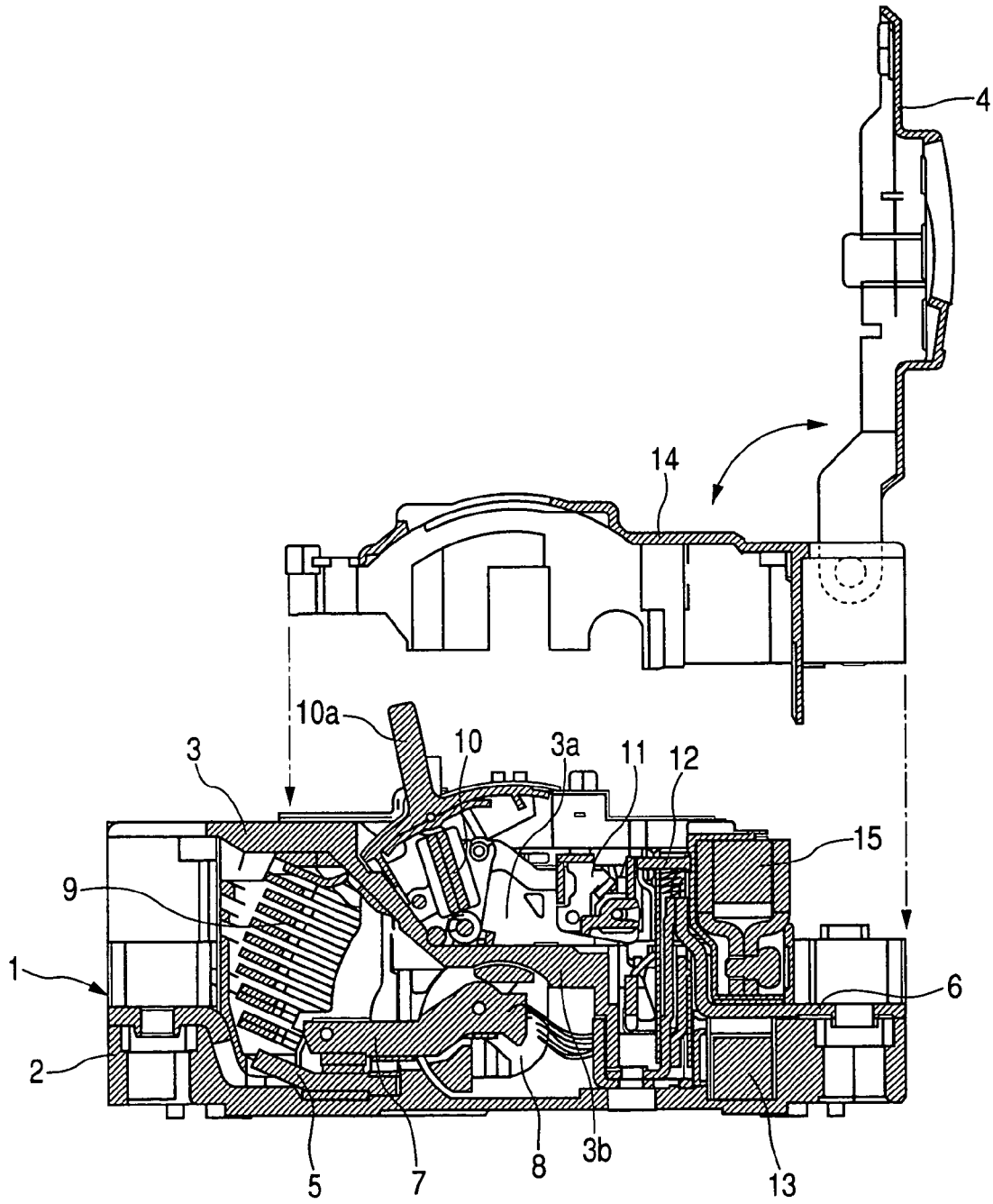
FIG. 1 is an exploded cross sectional view showing the arrangement of a circuit breaker according to example 1 of the invention in a state before mounting an auxiliary cover and a top cover.

In the following, embodiments of the invention will be explained on the basis of the examples shown in FIG. 1 to FIG. 3. In the drawings of the embodiments, components equivalent to those shown in FIG. 4 are denoted by the same reference numerals with the explanation being omitted.

Example 1

Figure 2:
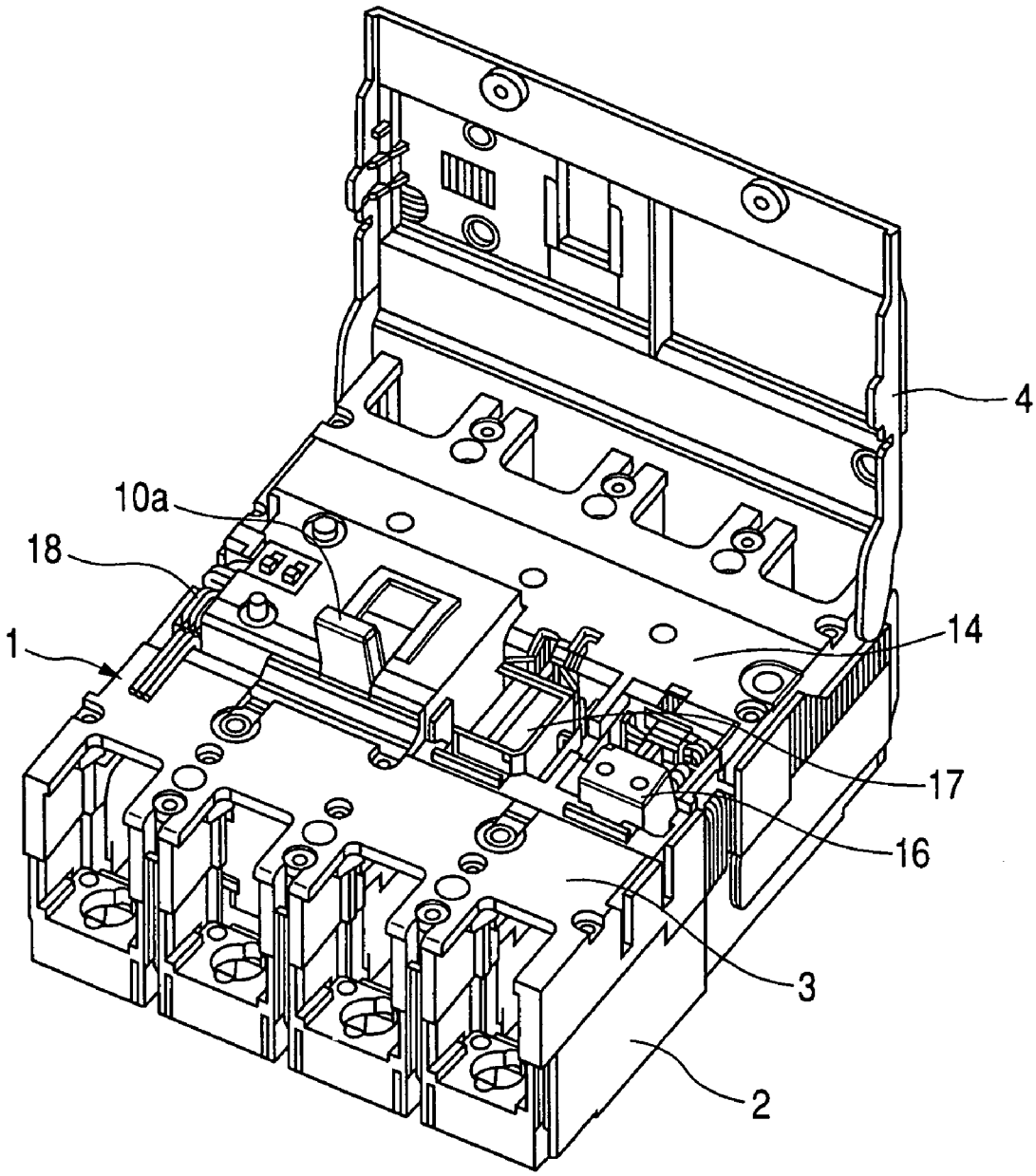
FIG. 2 is a perspective view showing a state in which the top cover is open after the circuit breaker shown in FIG. 1 is assembled.

First, with an earth leakage breaker taken as an example of a circuit breaker, an arrangement of the circuit breaker according to example 1 is shown in FIG. 1 and FIG. 2. Example 1 corresponds to the first and second aspects of the invention. FIG. 1 is a cross sectional view showing a state before mounting, in which functional parts explained in FIG. 4 are mounted on a main case 2 and a middle cover 3 of a molded case 1 with a top cover 4 and an additionally mounted new auxiliary cover 14 made separately. FIG. 2 is a perspective view showing a state in which the top cover 4 is open after the circuit breaker was assembled. In FIG. 1 and FIG. 2, components equivalent to those shown in FIG. 4 are denoted by the same reference numerals with the explanation thereof being omitted.

Here, the auxiliary cover 14 has a shape as shown in FIG. 2 which covers, except for the top side region of the containing section (the recess) of the interior attachments (an auxiliary and alarm switches 16 and a shunt release 17) formed in the middle cover 3, the top side regions of a switching mechanism 10 together with a bimetal overcurrent tripping device 12, an electromagnetic overcurrent tripping device 15 and a zero-phase current transformer (a leakage current detection section) 13, all being mounted on the main case 2 while being aligned on the back side of the switching mechanism 10. The auxiliary cover 14 is provided to fit the top side of the middle cover 3 and screwed to the main case 2 with the top cover 4 being hinged for opening and closing on the rear end section of the auxiliary cover 14. Reference numeral 18 denotes an overcurrent protection device mounted on the middle cover 3 where device is connected to a leakage current detection section with lead wires.

With the foregoing arrangement of the top cover 4 made accessible after the assembly of the circuit breaker, the switching mechanism 10 is covered with the auxiliary cover 14 as shown in FIG. 2. Therefore, in this state, with access to the containing section of the interior attachments in the middle cover 3 without causing any possible touch of a finger on the switching mechanism, mounting and removal of the attachments such as the auxiliary and alarm switches 16 and the shunt release 17 can be safely carried out.

Example 2

Figure 3:
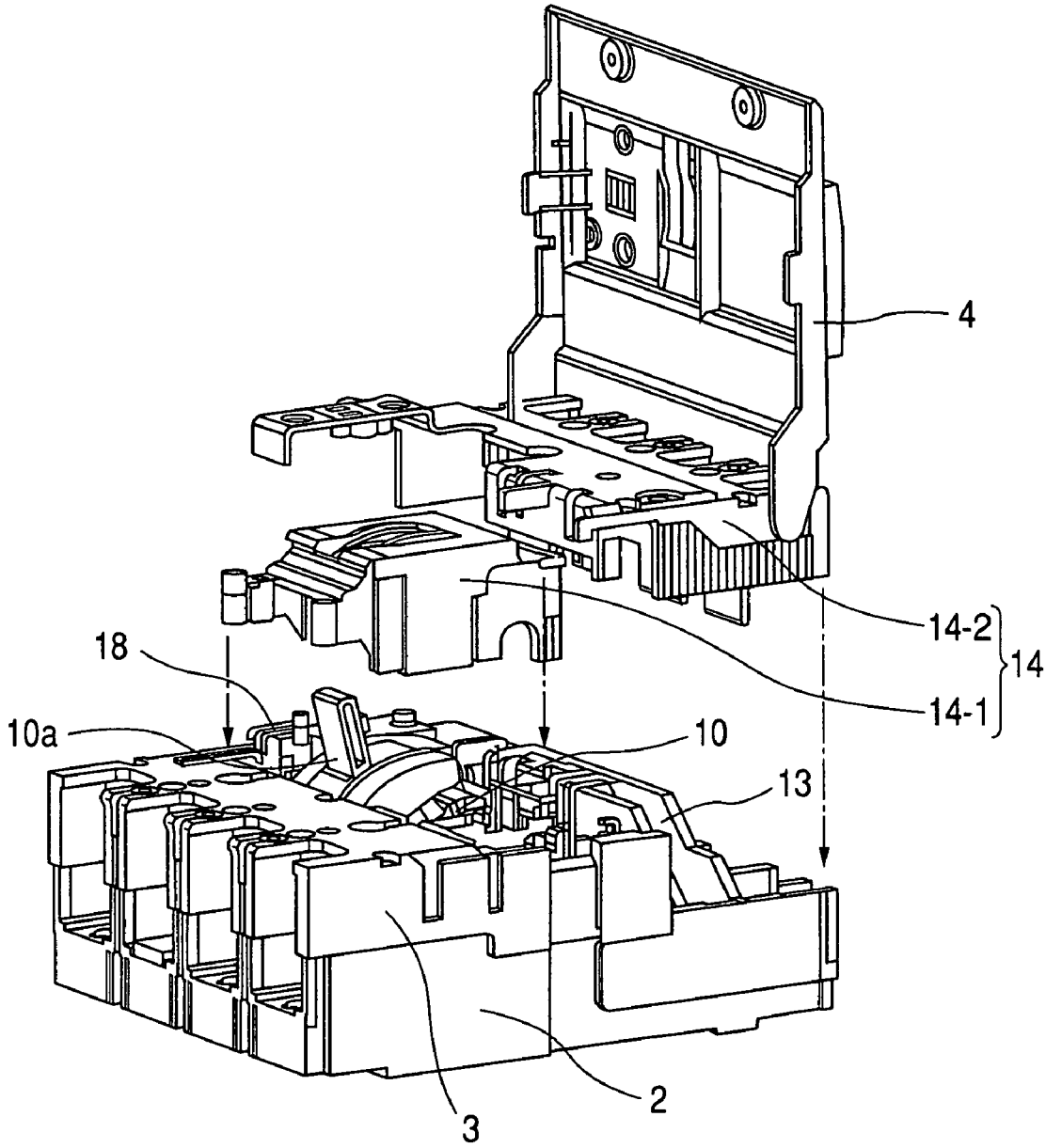
FIG. 3 is a perspective view showing the arrangement of a circuit breaker according to example 2 of the invention with a top cover open and an auxiliary cover removed from a main case.
Figure 4:
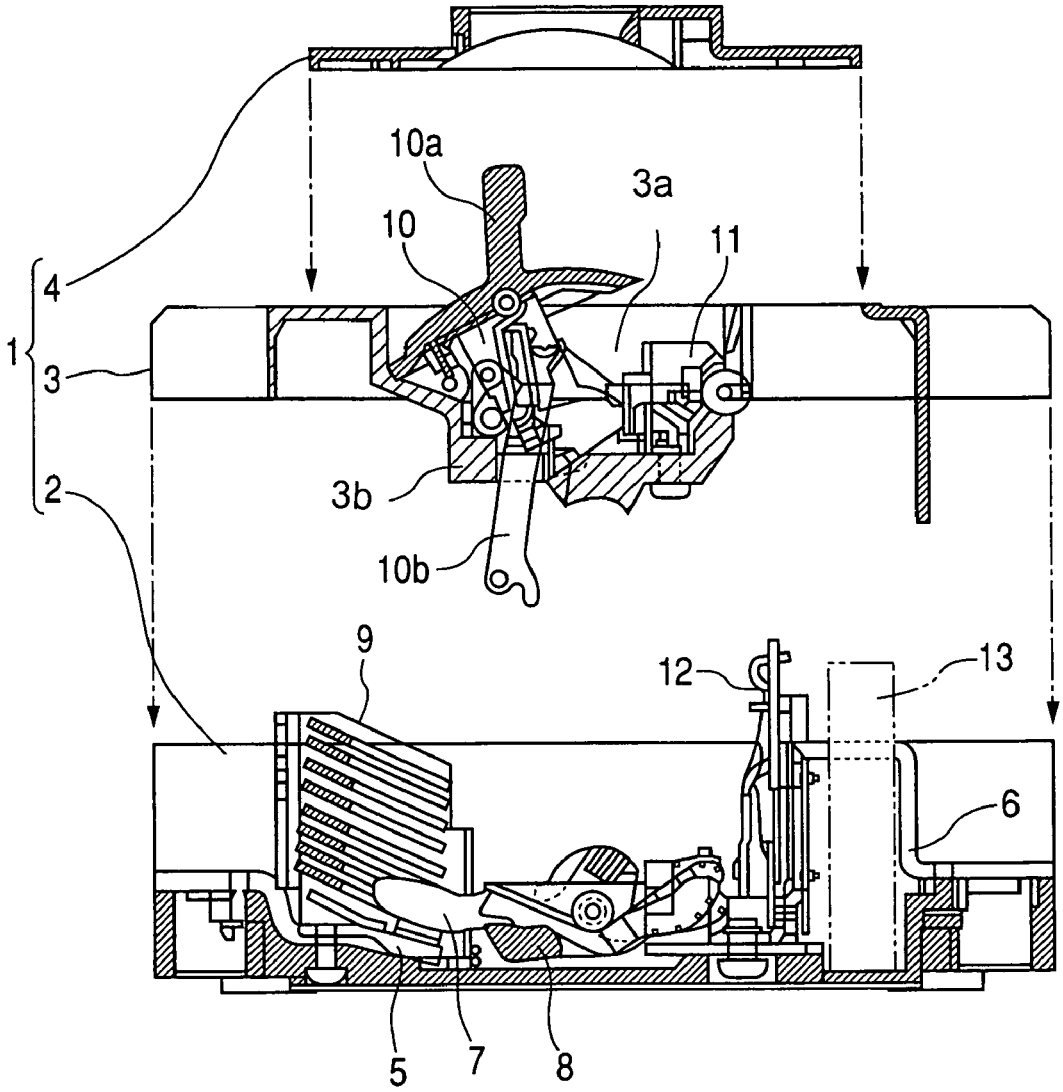
FIG. 4 Prior Art
FIG. 4 is a cross sectional view showing an arrangement of a circuit breaker with a background structure.

FIG. 3 is an exploded perspective view showing the arrangement of a circuit breaker according to example 2 corresponding to the third aspect of the invention with a top cover 4 open and an auxiliary cover 14 removed from a main case 2.

In example 2, the auxiliary cover 14 in the previously explained example 1 is divided into a cover section 14-1 and a cover section 14-2. The cover section 14-1 is an exclusive one for covering only the switching mechanism 10 mounted on the middle cover 3. The cover section 14-2 is one mounted on the main case 2 while being aligned on the back of the switching mechanism 10 for covering the top side region of the functional parts such as the overcurrent tripping devices 12 and 15 (see FIG. 1) and the zero-phase current transformer 13. Here, the cover section 14-1 is formed to have a box structure which is independently screwed to the main case 2 from the top to cover the switching mechanism 10 mounted on the middle cover 3. The other cover section 14-2 has a top cover 4 hinged on the rear end section thereof like in the foregoing example 1. Moreover, the left side of the cover is made to extend forward to cover the top side of the overcurrent protection device 18 provided at the side of the switching mechanism 10.

The dividable auxiliary cover 14 described above exhibits the effect as follows in the assembly process of the earth leakage breaker. Namely, in an assembly process before mounting the auxiliary cover 14 and the top cover 4, at the step at which mounting of various kinds of functional parts of a molded-case circuit breaker onto the middle cover 3 has been completed, the exclusive cover section 14-1 is placed over the switching mechanism 10 to be screwed onto the main case 2. In this state, the zero-phase current transformer 13 (the leakage current detection section) is additionally mounted on the main case 2. Furthermore, with the overcurrent protection device 18 mounted on the middle cover 3, wiring work between the two is carried out with lead wires. In this case, the switching mechanism 10 covered with the cover section 14-1 does not cause any possible tripping induced by a worker touching the switching mechanism 10 with a finger. Thus, the assembly work of the product can be carried out safely. After all of the functional parts are mounted, the cover section 14-2 of the auxiliary cover 14 and the top cover 4 are mounted on the top side of the middle cover 3, so that the assembly of the product is complete.

With the above arrangement, when the interior attachments (the auxiliary and alarm switches 16 and the shunt release 17 shown in FIG. 2) are mounted on or removed from the circuit breaker, the top cover 4 is opened in the same way as that explained about the arrangement shown in FIG. 3. This allows access to the containing section (the recess) of the attachments in the middle cover 3 without causing any possible touch of a finger on the switching mechanism 10 for safe mounting and removal of the attachments.

While the present invention has been particularly shown and described with reference to the preferred embodiments, it will be understood by those skilled in the art that the foregoing and other changes in form and details can be made without departing from the spirit and scope of the present invention.

The disclosure of Japanese Patent Application No. 2005-233947 filed on Aug. 12, 2005 is incorporated herein as a reference.

What is claimed is:

1. A circuit breaker comprising:

a main case containing a contactor section, an arc-extinguishing device and an overcurrent tripping device;

a middle cover laid on the main case, the middle cover having in a central section thereof a recess partitioned with a bottom wall for containing a switching mechanism and at least one interior attachment; and a top cover covering the top side of the recess in the middle cover, the main case, the middle cover and the top cover being arranged to be dividable from one another, wherein the middle cover has an auxiliary cover, covering the switching mechanism, and the auxiliary cover has the top cover mounted thereon, wherein the auxiliary cover covers a region except for a containing section of the at least one interior attachment and the top cover is hinged to the auxiliary cover at an end section thereof, and wherein the auxiliary cover is divided into a first cover section covering the switching mechanism and a second cover section covering a peripheral surface region of the switching mechanism, and the first cover section covering the switching mechanism is mounted on the main case.

2. The circuit breaker as claimed in claim 1, wherein the auxiliary cover is fixed onto the middle cover to substantially entirely cover the middle cover except for the at least one interior attachments so that when the auxiliary cover is attached to the middle cover, a mechanical portion of the switching mechanism is not touched.

3. The circuit breaker as claimed in claim 1, wherein the auxiliary cover covers, in addition to the switching mechanism, a bimetal overcurrent tripping device, an electromagnetic overcurrent tripping device and a zero-phase current transformer, and does not cover an auxiliary switch, an alarm switch and a shunt release.

4. A circuit breaker comprising:

a main case containing a contactor section, an arc-extinguishing device and an overcurrent tripping device;

a middle cover laid on the main case, the middle cover having in a central section thereof a recess partitioned with a bottom wall for containing a switching mechanism and at least one interior attachment; and a top cover covering the top side of the recess in the middle cover, the main case, the middle cover and the top cover being arranged to be dividable from one another, wherein the middle cover has an auxiliary cover, covering the switching mechanism, and the auxiliary cover has the top cover mounted thereon, wherein the auxiliary cover covers a region except for a containing section of the at least one interior attachment and the top cover is hinged to the auxiliary cover at an end section thereof, wherein the auxiliary cover is fixed onto the middle cover to substantially entirely cover the middle cover except for the at least one interior attachments so that when the auxiliary cover is attached to the middle cover, a mechanical portion of the switching mechanism is not touched, and wherein the auxiliary cover covers, in addition to the switching mechanism, bimetal overcurrent tripping device, an electromagnetic overcurrent tripping device and a zero-phase current transformer, and does not cover an auxiliary switch, an alarm switch and a shunt release.

5. The circuit breaker as claimed in claim 4, wherein the auxiliary cover is divided into a first cover section covering the switching mechanism and a second cover section covering a peripheral surface region of the switching mechanism, and the first cover section covering the switching mechanism is mounted on the main case.

* * * * *